United States Patent [19]

Seitz

[11] 3,999,704

[45] Dec. 28, 1976

[54] RESET DETENT MECHANISM FOR ROTARY COUNTER

[75] Inventor: Richard Seitz, Rockville, Conn.

[73] Assignee: Veeder Industries, Inc., Hartford, Conn.

[22] Filed: July 9, 1975

[21] Appl. No.: 594,213

[52] U.S. Cl. ..... 235/144 PN; 235/94 R; 235/117 R; 235/144 D

[51] Int. Cl.[2] ..... G06C 15/42

[58] Field of Search ..... 235/94 R, 117 R, 144 R, 235/14 RD, 144 PN

[56] References Cited

UNITED STATES PATENTS

| | | | |
|---|---|---|---|
| 3,188,005 | 8/1965 | Wright | 235/94 R |
| 3,523,642 | 8/1970 | Manke | 235/94 R |
| 3,637,999 | 1/1972 | Pappas | 235/144 D |
| 3,720,370 | 3/1973 | Young | 235/94 R |
| 3,727,833 | 4/1973 | Muller | 235/94 R |
| 3,906,206 | 9/1975 | Smilgys | 235/144 D |
| 3,920,964 | 11/1975 | Young | 235/94 R |

*Primary Examiner*—L. T. Hix
*Assistant Examiner*—Vit W. Miska
*Attorney, Agent, or Firm*—Prutzman, Hayes, Kalb & Chilton

[57] ABSTRACT

A fuel delivery pump with resettable volume and cost counters having counter resetting means with a zero detent mechanism for accurately positioning the lowest order number wheels of the counters at zero.

13 Claims, 5 Drawing Figures

RESET DETENT MECHANISM FOR ROTARY COUNTER

BRIEF SUMMARY OF THE INVENTION

The invention relates to counting devices and more specifically to resettable counters.

While not limited thereto, the invention has particular utility in connection with resettable counters of the type designed for registering the volume and cost of liquid dispensed, such as may be utilized in a gasoline station. The indicators of such counters are typically reset to zero between each successive transaction and the invention further relates to a resettable counter having improved resetting means.

It is an object of the present invention to provide an improved resetting mechanism for counters whereby the indicator zeroing function is rendered particularly accurate. Included in this object is the provision of a resetting mechanism which is capable of manual or semi-automatic operation.

It is a further object of the invention to provide an improved counter resetting mechanism which accurately resets each of a plurality of indicators exactly to a zero position and detents them thereat during conditioning of the counter for a subsequent registering or counting operation. Also included in this object is the provision of a zero detent mechanism which is effective to displace the indicators from a nearly zero position to an exact zero position.

These and other objects will be in part obvious and in part pointed out in greater detail hereinafter.

The invention accordingly consists in the features of construction, combination of elements and arrangement of parts which will be exemplified in the construction hereafter set forth and in the scope of the application which will be indicated in the appended claims.

BRIEF DESCRIPTION OF A PREFERRED EMBODIMENT

Figure 1:
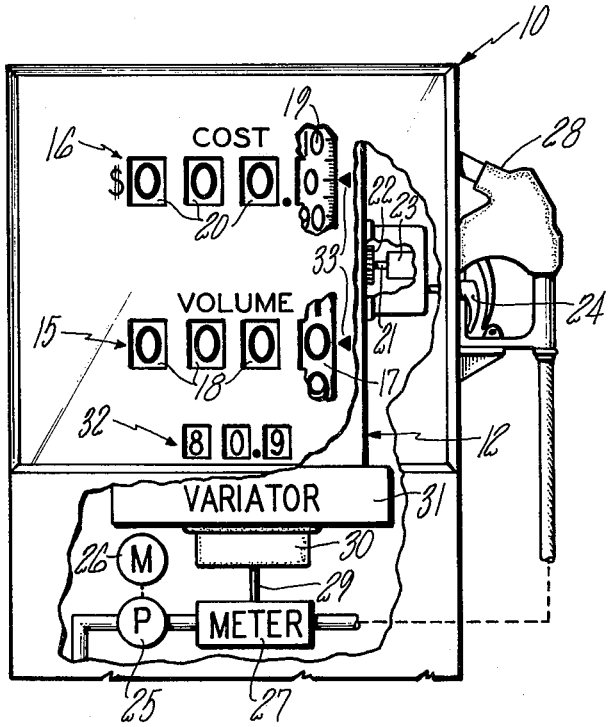
FIG. 1 is a generally diagrammatic representation, partly broken away, of a gasoline dispensing system incorporating a delivery register employing an embodiment of a counter reset mechanism of the present invention.

Referring now to the drawings in detail, wherein like numerals represent like parts, a gasoline dispensing system incorporating an embodiment of a resettable register or counter with a zero detent mechanism therefor is depicted according to the invention. FIG. 1 depicts, in diagrammatic form, a gasoline delivery pump generally designated 10 having a resettable mechanical counter or register 12. The register 12 is of a type similar but not entirely identical to that disclosed in U.S. Pat. No. 2,814,444 of Harvey N. Bliss dated Nov. 26, 1957 and entitled "Register." Only those aspects of register 12 which differ from the U.S. Pat. No. 2,814,444 and/or which are necessary to an understanding of the invention will be discussed in detail. Register 12 includes a pair of volume counters 15 and 15' for registering the volume amount of fuel delivered and a pair of cost counters 16 and 16' for registering the cost amount of fuel delivered. In the embodiment shown, the volume counter 15 includes a lowest order number wheel 17 and three additional higher order number wheels 18 and the cost counter 16 includes a lowest order number wheel 19 and three additional higher order number wheels 20. Volume counter 15' includes a similar arrangement of lowest order number wheel 17' and three higher order wheels (not shown) as does counter 16 with number wheels 19' and 20' respectively. A reset master or control shaft 21 is provided which is adapted to be rotated one revolution for resetting the volume and cost counters 15, 15', 16 and 16' to zero between fuel deliveries. Reset shaft 21 has a spur gear 22 fixed thereto for rotation therewith. Shaft 21 and gear 22 are rotated in a known manner, as for instance by motor 23, which in turn is actuated by control handle 24, for example as described in U.S. Pat. No. 3,142,442 to O. Wild, Jr. dated July 28, 1964 and entitled "Resetting Mechanism for Counters".

Figure 2:
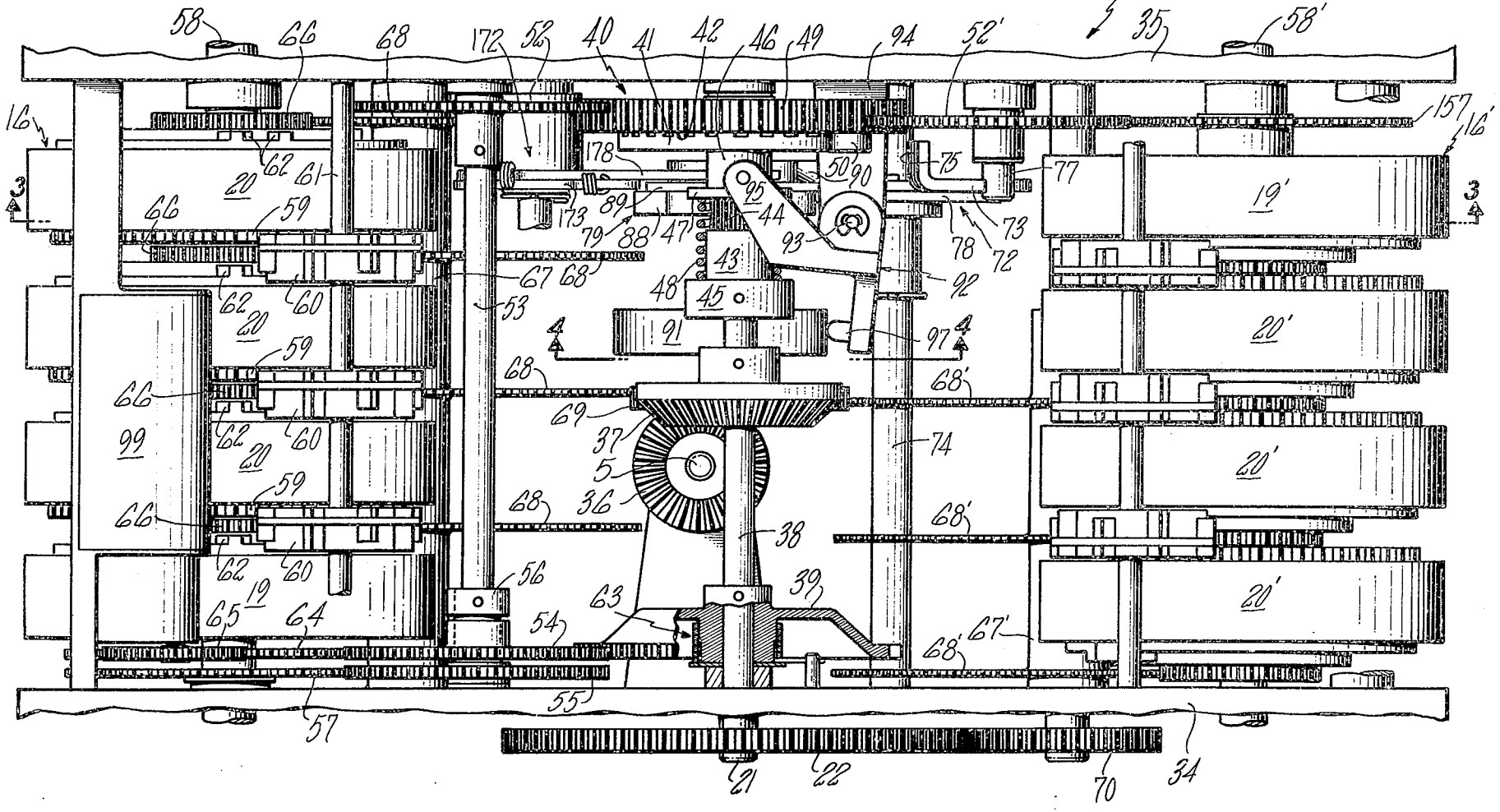
FIG. 2 is an enlarged partial plan view, partly broken away and partly in section, of the register.

The gasoline delivery pump comprises in a conventional manner a pump 25 driven by an electric motor 26 for delivering gasoline from a suitable source and via a fluid meter 27 to a dispensing nozzle 28. The meter output or volume shaft 29 is connected via a 10:1 reduction gearbox 30, for driving a suitable variator 31 (for example, a variator of the type disclosed and described in U.S. Pat. No. 3,413,867 of Richard B. Hamlin dated Dec. 3, 1968 and entitled "Variator") and for driving the volume counters 15, 15' for registering the volume amount of gasoline dispensed. The output shaft 5 of the variator 31, seen in FIG. 2, is connected for driving the cost counters 16, 16' to register the cost amount of gasoline dispensed in accordance with the volume amount dispensed and a unit volume price within the available price range established by the variator setting.

The 10:1 reduction gearbox 30 is intended to reduce the speed of volume shaft 29 by a factor of 10 prior to its introduction to variator 31. Such reduction in speed permits the lowest order cost wheels 19 and 19' to be graduated in equal fractions of 1 dollar (i.e., in 100 1-cent increments or graduations through 0, 1–99, to 0) and the lowest order volume wheels 17 and 17' to be graduated in equal fractions of 10 gallons (i.e., in 100, 1/10-gallon increments or graduations through 0, 1/10 – 9 9/10 to 0). This departure from prior convention is done in order to use existing variators, such as variator 31, at the relatively higher cost per volume fuel prices presently occurring and/or forecast and which is posted on the variator price posting indicator 32. The reduction in variator and register revolutions per unit of fuel delivered serves to reduce the wear on the counters and in particular the cost counters 16 and 16' which would otherwise be rotated at substantially higher speeds at the substantially higher unit volume prices.

Reference markers or arrows 33 are provided adjacent the lowest order wheel of each counter 15, 15', 16 and 16'. A marker 33 is positioned to coincide with an exact zero reference or reset position of the wheels of the respective counter, the reset position for the counter being determined and obtained in a manner to be hereinafter described in accordance with the invention. It will be appreciated that an accurate zeroing or resetting of the counters may be of considerable importance, particularly in the instance as in the described embodiment where each 3.6° of arc of a lowest order cost wheel 19 or 19' represents 1 cent.

Register 12 as a frame comprising side plates 34, 35 in which are journaled shafts 58, 58', 158 and 158' supporting the number wheels 19 and 20, etc. For brevity, description of only one counter, for instance cost counter 16, will hereinafter be made, with it being understood that the remaining three counters 15, 15' and 16' are similarly constructed and functioning unless stated to the contrary. Those elements of counters 15 and 15' which are identical to corresponding elements in counters 16 and 16' will be given the same number preceded by a 1 and are so numbered in the drawings.

Figure 3:
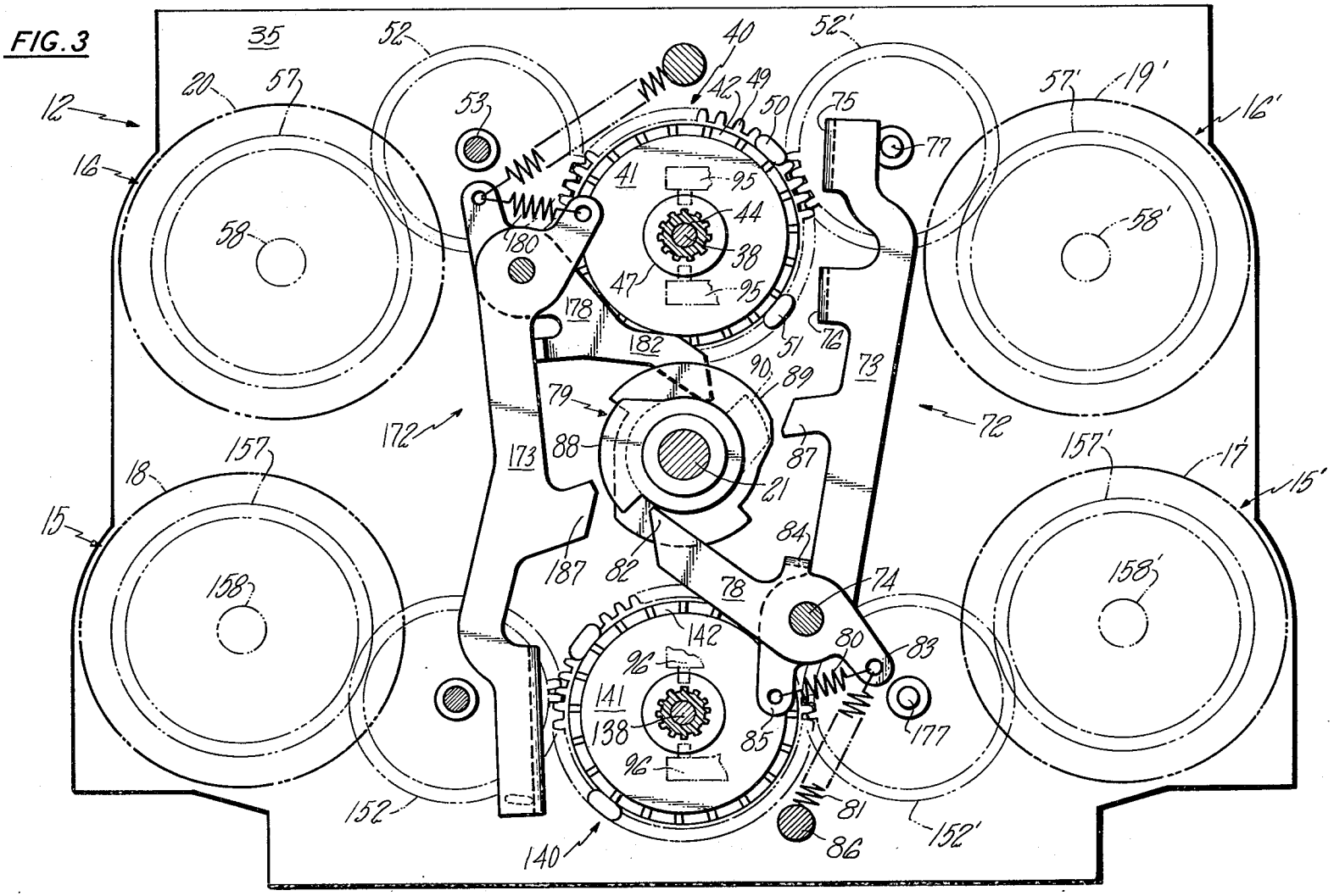
FIG. 3 is a transverse sectional view, partly broken away and partly in section, taken substantially along line 3—3 of FIG. 2.

Number wheels 19 and 20 are rotatably supported on a supporting shaft 58, seen in FIGS. 2 and 3, extending between support plates 34 and 35, there being one lowest order wheel 19 and several (in this instance three) sequentially higher order wheels 20 serially adjacent thereto. Referring to FIG. 2, the variator output shaft 5, following the 10:1 speed reduction, extends upwardly between support plates 34 and 35 to support and drive a bevel gear 36 affixed thereto. The bevel gear 36 meshes with another bevel gear 37 affixed for rotating a horizontal drive shaft 38 rotatably supported by support plates 34 and 35 near the elevation of counters 16 and 16'. A dished totalizer drive gear 39 is fixed to shaft 38 near the support plate 34, and an anti-backlash device 63 of the type disclosed in U.S. Pat. No. 3,847,347 issued to Bruno S. Smilgys on Nov. 12, 1974 and entitled "Rotary Drive Anti-Backlash Device" is housed between the gear 39 and support plate 34 and serves to minimize the inertial over-shoot and backlash effects otherwise present with the sudden cessation of a fuel delivery.

A clutch mechanism 40 is located near the other end of the horizontal shaft 38 adjacent the support plate 35. The clutch mechanism 40 is of a type known in the art and exemplified by U.S. Pat. No. 3,385,407 issued to R. J. Kleinhans et al. on May 28, 1968 and entitled "Clutch Mechanism for Counter Drive." The clutch 40 includes a rotary driving member 41 and a driven member 42.

The rotary driving member 41 of the clutch 40 is disposed in splined, axially movable, coaxial relationship about a bushing or sleeve 43, in turn coaxially fixed to shaft 38. Sleeve 43 includes a splined portion 44 along its forward end for mated engagement with the spline of member 41 and a radially enlarged collar 45 at its rearward end. Member 41 is thus axially, but non-rotatably, movable relative to sleeve 43. Driving member 41 includes a rearwardly or outwardly extending hub 46 having a radially enlarged collar 47 at its outer end. A coil compression spring 48 is coaxially disposed about sleeve 43 intermediate and contacting sleeve collar 45 and hub 47 to bias driving member 41 forward into engagement with driven member 52. Driving member 41 is axially shiftable inwardly out of engagment with driven member 42 to disengage the clutch and thereby disengage the drive train from the horizontal cost shaft through the clutch 40 to the cost counters 16, 16'. The volume counters 15, 15' are similarly driven by the variator center shaft 29 via bevel gearing (not shown), a horizontal volume shaft 138 and a clutch 140 and whereby the lowest order volume counter wheels 17, 17' are driven together via the clutch 140. Also, the clutch driving member 141 of the clutch 140 is axially shiftable inwardly out of engagement with the driven member to disengage the clutch and the drive train from the horizontal volume shaft 138 to the volume counters 15, 15'.

Driven member 42 is freely mounted coaxially on shaft 38 and is constructed to receive the drive member 42 in its biased forward position in positive torque transmitting engagement, as described in the referenced U.S. Pat. No. 3,385,407. Driven clutch member 42 has an integral spur gear 49 which includes a pair of angularly spaced bosses or abutments 50, 51, on the side thereof away from support plate 35, for a reason to be hereinafter explained.

A spur gear 52 is coaxially affixed to horizontally extending shaft 53 which is rotatably supported at its opposite ends by support plates 34, 35. Gear 52 is positioned to be in continuous meshing engagement with central gear 49. A pair of spur gears 54 and 55 are coaxially disposed on shaft 53 in axial juxtaposition near support plate 34. Gear 54 is freely mounted on shaft 53 and serves as an idler. Gear 55 is affixed to shaft 53 for rotation therewith. A locking collar 56 serves to axially position and maintain gear 54 between it and gear 55. Gear 55 is in continuous meshing engagement with a gear 57 fixed or connected for rotating the lowest order number wheel 19 of the cost counter 16. Similarly, a gear 52' is connected between the clutch output gear 49 and an input or drive gear 157 of the opposite cost counter 16'. Consequently, the opposed cost counters 16, 16' are driven by and positively coupled to the clutch output gear 49 and the two lowest order counter wheels of the two opposed cost counters 16, 16' remain positively coupled together even with the clutch 40 disengaged. Number wheel 19 is mounted for generally free rotation about axially movable, horizontally extending shaft 58 slideably and non-rotatably supported near opposite ends by support plates 34, 35. A mechanism known in the art, as exemplified in the above referenced U.S. Pat. No. 2,814,444, and not shown here, serves to reciprocably slide shafts 58, 58', 158 and 158' in unison in response to rotation of master shaft 21.

All of the number wheels 19 and 20 of counter 16 are generally freely rotatable about axially movable shaft 58 in close, axially sequential relationship. Each number wheel 20 includes a driven gear 59 therewith intermediate it and the next lower order wheel 20 or 19. Gears 59 and wheels 20 are structured such that they are in fixed rotational relationship when the shaft 58 is in an axial position commensurate with the counting or registering function and are free to rotate relative to one another when the shaft is shifted to the axial position commensurate with the resetting operation. Further, transfer pinions 60 are in engagement with each gear 59 and are rotatably supported on transverse shaft 61 supported by support plates 34, 35. A two-toothed driving gear 62 on each number wheel 19, 20 engages and partially rotates a corresponding pinion 60 following each complete revolution of the wheel to which gear 62 is fixed. Correspondingly, the partial revolution of pinion 60 is effective to rotate gear 59 sufficiently to step the associated wheel 20 one incremental unit, in this instance one-tenth of a full revolution. In this manner, lowest order wheel 19, initially driven by gear 55, rotates in accordance with the fuel delivered and the price per gallon previously established and upon one full revolution (representing $1.00 amount of fuel dispensed), it transfers a count to the number wheel 20 adjacent thereto by indexing it one increment. This operation occurs sequentially with the other wheels 20 also until completion of a particular delivery of fuel, at which time the accumulated cost (or volume on counter 15) for that delivery may be noted and/or logged. A more thorough description of the above described counting or registering mechanism of counter 16 and the later described resetting mechanisms associated directly therewith may be had by reference to the earlier noted U.S. Pat. No. 2,814,444, if desired.

Idler gear 54, in driven engagement with gear 39, is in turn in driving engagement with a gear 64 rotatably mounted on the axially shiftable counter shaft 58. Gear 64 in turn meshes with a gear 65 which is connected to drive a cumulative, non-resettable totalizer or counter (not shown) within housing 99, thereby providing a cumulative or nonpreset volume indication of the fuel delivered.

In order to reset or "zero" the counters 15, 15' and 16, 16' following a delivery, an improved reset mechanism is provided in accordance with the invention. Referring again to counter 15, a reset gear 66 is provided on each wheel 19, 20 on the opposite side of the corresponding wheel drive gear 57, 59. During a registering operation, the reset gears 66 are disconnected from wheels 19, 20; however, axial shifting of shaft 58 for a reset operation serves in a known manner to drivingly connect the reset gears with their corresponding wheels and to concurrently disconnect the normal drive gears 59 from the wheels 20. A shaft 67 extends between and is rotatably supported by support plates 34, 35. Initial or primary reset gears 68 are fixed to shaft 67 at axially spaced positions which place them in meshed engagement with the wheel reset gears 66. Reset gears 68 are also in meshed engagement with the wheel reset gears of counter 15. A similar shaft 67' and primary reset gears 68' are associated with counters 15' and 16', though one reset gear 68' has been omitted as will be later explained. An idler gear 69 is rotatably mounted on master reset shaft 21 intermediate shafts 67, 67' and is positioned axially to be in meshed engagement with a gear 68 and 68' on each of the shafts 67, 67'. Either shaft 67 or 67' may be rotated (in this instance 67') by a gear 70 affixed thereto outside support plate 34 and in intermittent driven engagement with master reset gear 22, as described in the referenced U.S. Pat. No. 3,142,442. Typically, gear 22 will drivingly engage gear 70 after about 45° of rotation. This is sufficient, with proper gear sizes, to provide a full resetting revolution to every wheel reset gear 66. Each wheel 19, 20 (19', 20'; 17, 18; 17', 18') is rotated to a reset or "zero" position substantially corresponding with the marker 33. Pawls (not shown) within each wheel 19, 20 are operative in the reset mode in a known manner to detent the wheel when it arrives at a rotational position corresponding with "zero". However, such detenting arrangements typically have tolerance which allow some angular variation of the wheel 19, 20 from a precisely zeroed reset position. The secondary "zero" detent of the invention is intended to insure an accurate final zeroing or resetting of the wheels, particularly the lowest order wheels 19.

The zero detent mechanism of register 12 is seen in FIGS. 2 and 3 and comprises a pair of substantially identical detent assemblies 72 and 172, respectively associated with the cost and volume counters 16, 16' and 15, 15' respectively. Referring to detent assembly 72, an upwardly extending detent lever arm 73 is mounted near its lower end for pivotal movement about shaft 74 which extends transversely between and is supported by support plates 34, 35. Arm 73 is preferably of a rigid, durable material, such as brass or the like, and includes a pair of spaced, rigid contact pads or surfaces 75, 76, also of brass, near the upper end thereof. Contact pads 75, 76 are radially and transversely positioned along arm 73 such that they may each contact an abutment 50, 51 on gear 49 upon counterclockwise rotation of the arm as viewed in FIG. 3. Pads 75 and 76 may be formed by bending or otherwise shaping the leading edge of the arm 73 at a 90° angle to the plane in which the arm pivots, or by welding or otherwise affixing contact pads to the leading edge. Contact pads 75, 76 might be a continuous surface or, as in a preferred embodiment, they may be radially spaced with an intermediate portion of arm 73 recessed or cutaway to avoid contact of the remainder of the arm with gear 49.

Abutments 50 and 51 on gear 49 are preferably of a hard, durable material, such as brass, and are fixed to the gear as by welding or brazing. In preferred embodiment, abutments 50, 51 are each oblong, eliptical members with tangentially extending primary axes and are positioned on the side of the gear at or near its outer diameter. Abutments 50, 51 are angularly or circumferentially spaced on gear 49, in this instance by about 90°, and are located such that concurrent, nonmoving contact with each of the contact pads 75, 76 occurs at, and only at, a rotational orientation of the gear which corresponds with an exactly zeroed or reset orientation of number wheel 19 (and 20). Abutments 50, 51 are shaped and oriented to present curved surfaces to the contact pads 75, 76 to facilitate achieving the exactly "zeroed" orientation, as by a limited camming action when one pad and abutment come into contact before the other. Lever arm 73, and accordingly contact pads 75, 76, pivot between a disengaged position shown in FIGS. 2 and 3 in which the arm is at rest near stub shaft 77 and an engaged position in which the pads and abutments 50, 51 are in zeroed, nonmoving complementary contact.

The angular positioning of detent arm 73 is determined and controlled by arming lever 78, compound cam 79 and tension springs 80 and 81. Arming lever 78 is rotatably mounted on detent shaft 74 axially adjacent detent arm 73 and has tail end 82 and end 83 on opposite sides of the center of rotation at shaft 74. Arming lever 78 further includes a stop member 84 extending transversely thereof intermediate shaft 74 and tail end 82 for nonyielding contact with detent arm 73. Arming lever 78 is angularly oriented to place tail end 82 in contact with compound cam 79 such that stop member 84 may resist counterclockwise rotation of detent arm 73.

A tension spring 81 is connected at one end to an anchor shaft 86 supported by plates 34, 35 below detent shaft 74 and at the other end to end 83 of arming lever 78, thereby urging lever 78 and its tail end 82 clockwise into contact with cam 79, and more specifically, cam surface 88 thereof.

A tension spring 80 is connected at one end to end 83 of arming lever 78 and at the other end to the lower end 85 of detent arm 73, thereby urging detent arm 73 in a counterclockwise rotational direction toward or into contact with stop member 84.

Compound cam 79, seen in its 0° displacement position, is fixed to main reset shaft 21 for rotation clockwise therewith and includes three cam surfaces 88, 89 and 90 in serial axial juxtaposition. Surface 88, seen entirely in solid outline in FIG. 3, provides the camming surface for tail end 82 of cocking lever 78. Surface 89, seen partially in solid outline and partially in long dotted outline, provides the camming surface for cam follower legs 87 and 187 of detent arms 73 and 173 respectively, the legs extending toward the cam surface from a position on the arms between the detent shaft and the contact pads. Surface 90, seen in short dotted outline, provides the camming surface for tail end 182 of cocking lever 178.

Figure 5:
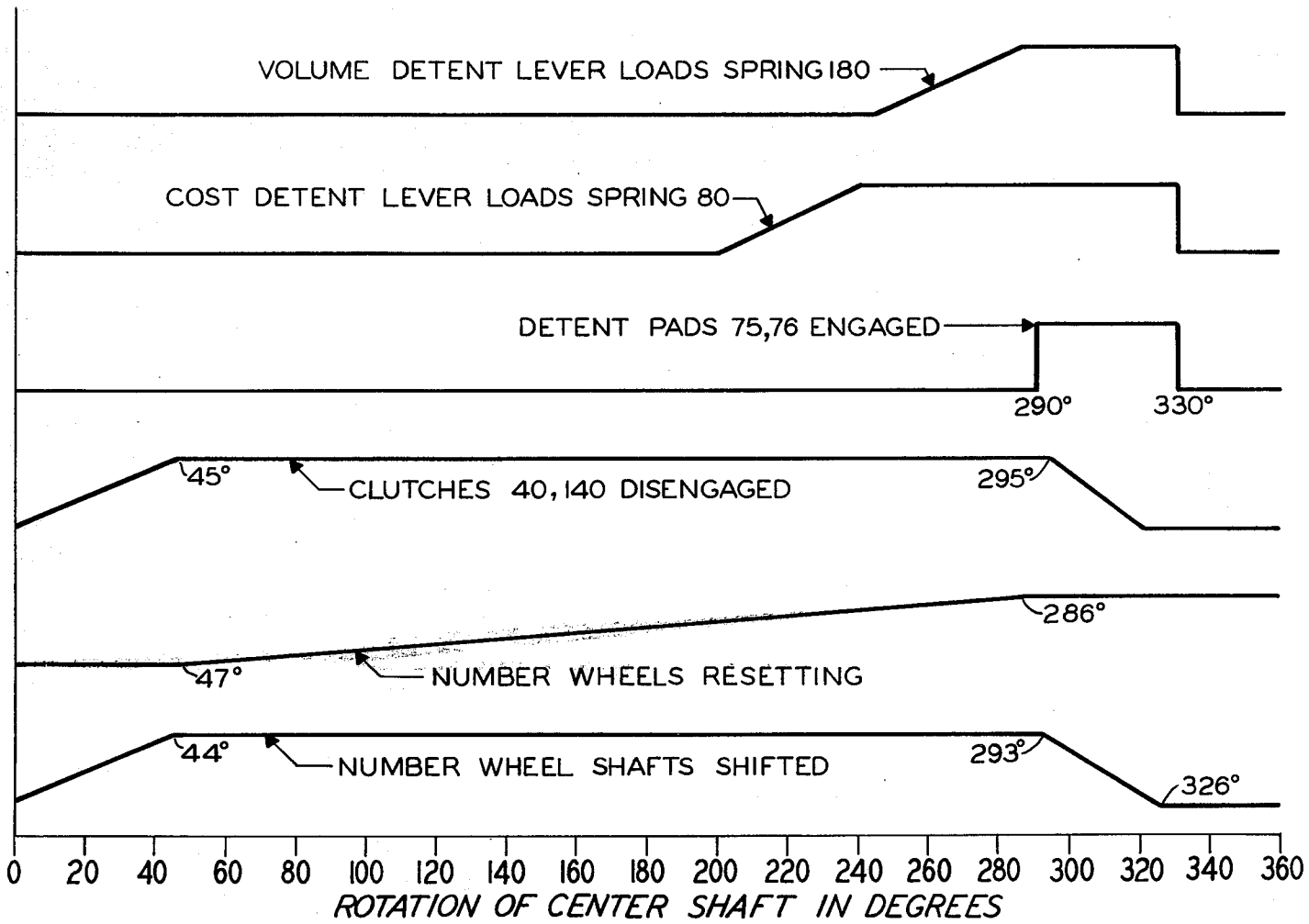
FIG. 5 is a timing diagram graphically depicting the angular timing of certain resetting activities during rotation of the control shaft.

Referring to FIGS. 3 and 5, rotation of cam surface 88 maintains arming lever 78 in the "detent disengaging" configuration of FIG. 3 until an angle of about 200°–240° at which time it is rotated counterclockwise such that stop member 84 is moved away from detent arm 73. Though arm 73 attempts to follow, its cam follower leg 87 promptly contacts the cam surface 89 to maintain the arm and its contact pads 75, 76 away from gear 49 and abutments 50, 51. This relationship is maintained with spring 80 loaded until cam surface 89 drops sharply at 290° rotation, allowing arm 73 to rotate rapidly counterclockwise to bring pads 75 and 76 respectively into smart, centering or zeroing contact with abutments 50, 51. This zeroing and detenting contact with gear 49 continues until about 330° of rotation, at which time cam surface 88 drops sharply to permit rapid clockwise rotation of cocking lever 78 by spring 81, thereby relatively unloading spring 80 and permitting stop member 84 to recontact arm 73 and move it clockwise out of contact with the gear and to its original disengaged position.

Detent arm 173 is actuated in essentially the same manner as arm 73, however, cam surface 90 is contoured such that cocking arm 178 is rotated away from arm 173 to load spring 180 through a cam displacement angle of about 240°–280°. This follows the loading of spring 80, thus obviating the need for sufficient torque on shaft 21 to concurrently load springs 80 and 180.

It will be appreciated that most of the required operation of detent arm 72 might be accomplished without arming lever 78 if cam 79 were recontoured. However, arming lever 78 does enable arm 73 to be rapidly disengaged in the relatively short angular period (330°–360°) near the end of the reset cycle.

Figure 4:
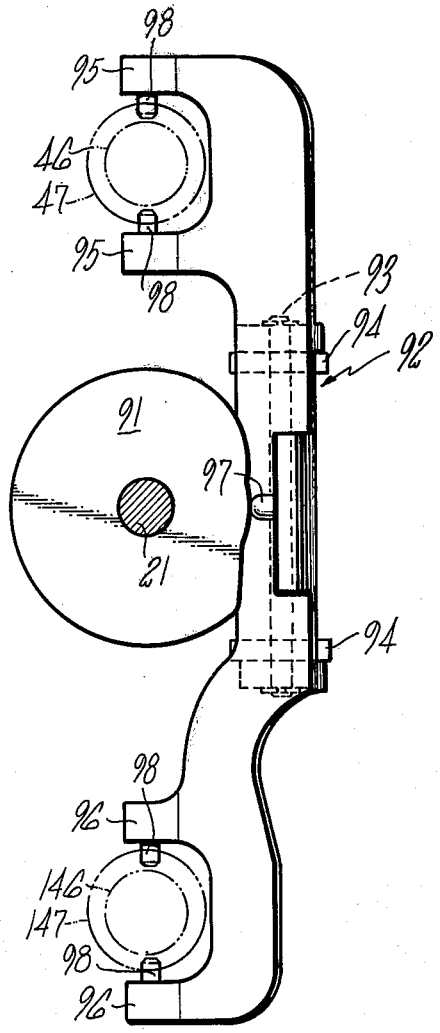
FIG. 4 is a transverse sectional view, partly broken away and partly in section, taken substantially along line 4—4 of FIG. 2.

A clutch yoke 92, as seen in FIGS. 2 and 4, actuates the drive clutch member 41 between driving engagement and disengagement with the driven clutch member 42 fixed to gear 49. Yoke 92 is supported for rotation about a vertical axis or shaft 93, in turn supported by a pair of rigid, vertically spaced support members 94 extending horizontally inward from support plate 35. Yoke 92 comprises a modified bell crank having an upper pair 95 and a lower pair 96 of spaced jaws extending outward from axis 93 in one direction and a cam follower 97 extending outward in another direction for contact with cam 91. Cam 91 is fixed to control shaft 21 for rotation therewith and positioned to contact cam follower 97. Upper and lower pairs of jaws 95 and 96 are each vertically spaced and extend to receive hubs 46 and 146 respectively therebetween and within spaced relation. A contact pin 98 is connected to each jaw of pairs 95 and 96 and they extend radially inward toward hubs 46 and 146 beyond the outer diameter of collars 47 and 147 but out of radial contact with the hub. Counterclockwise rotation of yoke 92, as viewed in FIG. 2, brings pins 98 into generally axially directed contact with the hub collars 47 and 147 and continued rotation of the yoke serves to axially displace the hubs and their drive members 41, 141 out of driving engagement with members 42, 142.

Cam 91 is contoured to effect this disengagement of clutches 40 and 140 between 0°–45° angular displacement, to maintain them disengaged until about 295° of displacement, and to re-engage them between 295°–320° of displacement. The disengagement of clutches 40 and 140 is timed to coincide with the resetting of register 12, both by the primary reset gears 68, 68' and by the "zeroing" detent action of detent mechanism 72 and 172.

As noted earlier, shaft 67' supports only three primary reset gears 68' instead of four, the omitted one being that normally associated with lowest order number wheels 17' and 19'. Instead, gears 57' and 157' are fixedly connected to and are coaxial with wheels 17' and 19' respectively, similar to gears 57 and 157. Gears 57' 157' are in meshed engagement with, respectively, idler gear 52' freely mounted on stub shaft 77 and idler gear 152' freely mounted on stub shaft 177. Gears 52' and 152' are in continuous meshed engagement with central gears 49 and 149 respectively. Thus, the wheels 17' and 19' are preferably without even the conventional zero detent pawls located in all of the other number wheels. In effect, wheels 17' and 19' are initially reset to the near zeroed position through their positive and continuous rotary linkage with wheels 17 and 19 which are in turn reset by primary reset gear 68. Similarly, they receive their registering or counting drive from central gears 49, 149, through idlers 52', 152' and wheel drive gears 57', 157'.

To reset register 12, control shaft 21 is rotated 360°. FIG. 5 depicts the angular timing of several of the more significant events in the 360° cycle. From 0°–44° the shafts 58, 58', 158 and 158' are shifted axially to condition the number wheels for resetting. From 0°–45°, the clutch drive members 41, 141 are moved out of engagement with driven members 42, 142 respectively. Clutches 40, 140 remain completely disengaged until 295°. From 47° to 286°, the primary reset shafts 67, 67' are rotated sufficiently to complete a full resetting revolution of all of the number wheels of register 12. At 290°, the zeroing detents 72, 172 are abruptly actuated into engagement with the abutments on central gears 49, 149 respectively to accurately zero and hold the lowest order wheels 17, 17', 19 and 19'. Gears 49, 149 remain locked or detented until 330°, during which time clutches 40, 140 are re-engaged and wheel shafts 58, 58', 158 and 158' are shifted to their normal registering positions. The cycle is essentially complete at 330°, allowing a margin of 30° to complete the revolution of master shaft 21.

While a preferred embodiment of the invention has been shown and described, various modifications and substitutions may be made thereto without departing from the spirit and scope of the present invention. Accordingly, it is to be understood that the present invention has been described by way of illustration and not limitation.

I claim:

1. A resettable rotary counter having at least one rotatable counter wheel providing a first order counter wheel, reset means operable for angularly resetting each rotatable counter wheel to a predetermined angular reset position thereof and control means operable for sequentially conditioning the counter for a resetting operation and a counting operation and for automatically operating the reset means to reset each counter wheel while the counter is conditioned for a resetting operation, the reset means comprising first resetting means automatically operable by the control means for resetting each counter wheel, including the first order counter wheel, to a rest position at substantially its predetermined reset position and second separate resetting means automatically operable by the control means after the automatic operation of the first resetting means by the control means for rotating said first order counter wheel from its said rest position exactly to its said reset position and retaining it at its exact reset position until the counter is conditioned by the control means for a counting operation.

2. The resettable rotary counter of claim 1 wherein the counter comprises a plurality of coaxial counter wheels of ascending order and wherein said second resetting means comprises detent means operable by the control means for detenting said first order counter wheel to exactly said angular reset position.

3. The resettable rotary counter to claim 2 wherein the detent means comprises abutment means connected to the first order counter wheel, a shiftable detent arm shiftable into engagement with the abutment means to exactly angularly reset said first order counter wheel and shiftable by the control means to engage the abutment means to exactly angularly reset the lowest order counter wheel and hold it as its reset position until the counter is conditioned by the control means for a counting operation.

4. In a resettable register having two resettable cost counters and two resettable volume counters, each of said counters having a plurality of coaxial rotary number wheels of ascending order, first and second separate rotary drive means for the cost and volume counters respectively, reset means operable for angularly resetting the cost and volume counter number wheels, and control means for sequentially conditioning said register for a resetting operation and a counting operation and for operating the reset means to reset the number wheels while said register is conditioned for a resetting operation; the improvement wherein each rotary drive means comprises a rotary drive train positively connecting the lowest order number wheels of the respective counters for common angular rotation, a rotary input, and clutch means operable by said control means for sequentially disengaging and re-engaging the rotary input to the rotary drive train for the resetting and counting operations respectively; and wherein the reset means comprises first and second detent means for the cost and volume counters respectively and comprising first and second detent abutment means on the rotary drive trains respectively, first and second shiftable detent arms shiftable in respective one direction thereof into engagement with said first and second detent abutment means respectively for exactly angularly positioning the respective rotary drive trains and thereby exactly angularly resetting the lowest order number wheels of the cost and volume counters respectively, and first and second detent arm actuating means operable by said control means for shifting said first and second detent arms in their said one directions respectively into engagement with said first and second abutment means to accurately angularly reset the the lowest order number wheels of the cost and volume counters and for retaining the detent arms in engagement therewith to hold the number wheels at their reset positions until the first and second clutch means are re-engaged and for thereafter shifting the detent arms in their respective opposite directions away from the abutment means.

5. The resettable register of claim 4 wherein said control means comprises a rotatable shaft operable in one direction of rotation thereof as the control means is operated to sequentially condition the counter for resetting and counting operations, wherein the detent arm actuating means comprise detent control cam means and arming cam means on the shaft, said first and second detent arms being mounted for pivotal movement about first and second pivotal axes respectively extending parallel to the axis of said rotatable shaft and pivotal in respective one directions thereof for engagement with the detent control cam means and the respective detent abutment means, said first and second detent arm actuating means further comprising first and second arming levers respectively, pivotally mounted about axes extending parallel to the axis of said shaft for pivotal movement in respective one directions thereof into engagement with the arming cam means and with the first and second detent arms respectively to pivotally withdraw the respective detent arms in their respective opposite pivotal directions from the respective detent abutment means, biasing means urging said first and second arming levers and said first and second detent arms in their respective one pivotal directions; said arming cam means being operable in said one direction of rotation of the shaft to sequentially pivot said first and second arming levers in their respective opposite pivotal directions to withdraw them from the respective detent arms to permit said first and second detent arms to be controlled by said detent control cam means, said detent control cam means being operable upon continued rotation of the shaft in said first direction to permit said first and second detent arms to be pivoted into engagement with the respective first and second abutment means by the biasing means to exactly angularly reset the lowest order number wheels, and said arming cam means being operable upon continued rotation of the shaft in said one direction and after re-engagement of said first and second clutch means to pivot the first and second arming levers in their respective one pivotal directions to withdraw said first and second detent arms from the detent abutment means respectively.

6. In a resettable register having two resettable counters, each having a plurality of coaxial rotatable number wheels of ascending order, counter drive means for driving the two counters together for accumulating the same count with each counter, reset means operable for angularly resetting the number wheels of the two counters, and control means operable for sequentially conditioning said register for a resetting operation and a counting operation and for automatically operating the reset means to reset the number wheels of the two counters while the register is conditioned for a resetting operation; the improvement wherein the counter drive means comprises a rotary drive train positively interconnecting the lowest order number wheels of the two counters for common angular rotation, a rotary input, and clutch means operable for selectively connecting said rotary input to said rotary drive train; wherein the control means operates the clutch means to disengage and re-engage the clutch means for the resetting and counting operation respectively, and wherein the reset means comprises first resetting means automatically operable by the control means for resetting each of the number wheels to a rest reset position thereof and detent means having detent abutment means connected to said rotary drive train, a shiftable detent arm shiftable into engagement with the detent abutment means to angularly position said rotary drive train to a predetermined angular position thereof and to thereby accurately angularly reset the lowest order number wheel of each of the two resettable counters from its said rest reset position to a predetermined exact reset position, and detent arm actuating means automatically operable by said control means for shifting said detent arm into engagement with said detent abutment means to accurately reset the lowest order number wheels while the register is conditioned for a resetting operation and after the number wheels have been reset to their rest reset positions respectively by the first resetting means and for holding the detent arm in engagement with the abutment means to hold the lowest order wheels at their exact reset angular positions respectively until after said clutch means is re-engaged by the control means.

7. The resettable register of claim 6 wherein said rotary drive train comprises a rotary gear train with a plurality of at least three gears.

8. In a resettable register having two resettable counters, each having a plurality of coaxial rotatable number wheels of ascending order, counter drive means for driving the two counters together for accumulating the same count with each counter, reset means operable for angularly resetting the number wheels of two counters, and control means operable for sequentially conditioning said register for a resetting operation and a counting operation and for operating the reset means to reset the number wheels of the two counters while the register is conditioned for a resetting operation; the improvement wherein the counter drive means comprise a rotary drive train positively interconnecting the lowest order number wheels of the two counters for common angular rotation, a rotary input, and clutch means operable for selectively connecting said rotary input to said rotary drive train; wherein the control means operates the clutch means to disengage and re-engage the clutch means for the resetting and counting operations respectively, and wherein the reset means comprises first resetting means for resetting the number wheels and detent means having detent abutment means connected to said rotary drive train, a shiftable detent arm shiftable into engagement with the detent abutment means to angularly position said rotary drive train and thereby accurately angularly reset the lowest order number wheels, and detent arm actuating means operable by said control means for shifting said detent arm into engagement with said detent abutment means to accurately reset the lowest order number wheels while the register is conditioned for a resetting operation and after the number wheels have been reset by the first resetting means and for holding the detent arm in engagement with the abutment means to hold the lowest order wheels at their reset angular positions until after said clutch means is re-engaged by the control means, the rotary drive train comprising a rotary gear train with a plurality of gears, the detent abutment means comprising a pair of angularly spaced abutments on the side of one of said gears, the said pair of abutments and said detent arm being shaped and oriented so that contact by the detent arm with either abutment results in rotation of said one gear to rotate the other abutment into engagement with the detent arm to prevent further rotation thereof when said lowest order number wheels are accurately angularly reset.

9. In a resettable register having two resettable counters, each having a plurality of coaxial rotatable number wheels of ascending order, counter drive means for driving the two counters together for accumulating the same count with each counter, reset means operable for angularly resetting the number wheels of the two counters, and control means operable for sequentially conditioning said register for a resetting operation and a counting operation and for operating the reset means to reset the number wheels of the two counters while the register is conditioned for a resetting operation; the improvement wherein the counter drive means comprises a rotary drive train positively interconnecting the lowest order number wheels of the two counters for common angular rotation, a rotary input, and clutch means operable for selectively connecting said rotary input to said rotary drive train; wherein the control means operates the clutch means to disengage and re-engage the clutch means for the resetting and counting operations respectively, and wherein the reset means comprises first resetting means for resetting the number wheels and detent means having detent abutment means connected to said rotary drive train, a shiftable detent arm shiftable into engagement with the detent abutment means to angularly position said rotary drive train and thereby accurately angularly reset the lowest order number wheels, and detent arm actuating means operable by said control means for shifting said detent arm into engagement with said detent abutment means to accurately reset the lowest order number wheels while the register is conditioned for a resetting operation and after the number wheels have been reset by the first resetting means and for holding the detent arm in engagement with the abutment means to hold the lowest order wheels at their reset angular positions until after said clutch means is re-engaged by the control means, the said control means comprising a rotatable shaft and being operable to rotate the control shaft in one angular direction, as it is operated, to sequentially condition the register for resetting and counting operations, the detent arm actuating means comprising detent control cam means mounted on the rotatable shaft, the detent arm having a cam follower engageable with the cam means and being pivotally mounted for being pivotally shifted in one pivotal direction thereof under the control of the cam means into engagement with the detent abutment means, the detent arm actuating means further comprising an arming lever pivotally mounted for engagement with the cam means and pivotal in one direction thereof under the control of the cam means to engage and pivot the detent arm in its opposite pivotal direction away from the abutment means, biasing means for pivotally urging the arming lever and the detent arm in their said one pivotal directions respectively, said cam means being operable in said one direction of rotation of the control shaft to provide for sequentially pivoting the arming lever in its opposite pivotal direction to withdraw it from the detent arm and thereby permit the detent arm to be controlled by the detent cam means, pivoting the detent arm in its said one pivotal direction into engagement with said abutment means to accurately angularly reset the lowest order number wheels, and, after the clutch means is re-engaged by the control means, pivoting said arming lever in its said one pivotal direction to withdraw the detent arm from said abutment means.

10. The resettable register of claim 9 wherein said cam means includes first and second axially spaced cams on said shaft for the arming lever and detent arm respectively.

11. The resettable register of claim 9 wherein the control means comprises clutch cam means driven by said shaft, clutch actuating means operable by said clutch cam means to sequentially disengage and re-engage said clutch means for the resetting and counting operations respectively, said clutch cam means being operable in said one direction of rotation of said shaft to operate the clutch actuating means to disengage the clutch means prior to said pivoting the arming lever in its said opposite pivotal direction and to re-engage the clutch means prior to said pivoting the arming lever in its said one pivotal direction to withdraw the detent arm from said abutment means.

12. The resettable register of claim 9 wherein said detent control cam means is operable to permit the detent arm to be rapidly pivoted in its said one pivotal direction by the said biasing means to provide said accurate angular resetting of the lowest order number wheels.

13. The resettable register of claim 9 wherein said detent control cam means is operable to permit the arming lever to be rapidly pivoted in its said one direction by said biasing means to provide rapid withdrawal of the detent arm from the detent abutment means.

* * * * *